US009244415B2

(12) United States Patent
Yamaguchi et al.

(10) Patent No.: US 9,244,415 B2
(45) Date of Patent: Jan. 26, 2016

(54) IMAGE FORMING APPARATUS HAVING TWO OR MORE LIGHT RECEIVING UNITS

(75) Inventors: Atsuhiko Yamaguchi, Suntou-gun (JP); Satoru Koyama, Mishima (JP); Shuhei Watanabe, Susono (JP); Takuya Mukaibara, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/117,419

(22) PCT Filed: Jun. 7, 2012

(86) PCT No.: PCT/JP2012/065174

§ 371 (c)(1), (2), (4) Date: Nov. 13, 2013

(87) PCT Pub. No.: WO2013/002031

PCT Pub. Date: Jan. 3, 2013

(65) Prior Publication Data

US 2014/0308049 A1 Oct. 16, 2014

(30) Foreign Application Priority Data

Jun. 30, 2011 (JP) ..... 2011-146334
Aug. 26, 2011 (JP) ..... 2011-185258

(51) Int. Cl.
*G03G 15/00* (2006.01)
*G03G 15/01* (2006.01)

(52) U.S. Cl.
CPC ..... *G03G 15/5025* (2013.01); *G03G 15/0131* (2013.01); *G03G 15/0189* (2013.01); *G03G 15/5058* (2013.01); *G03G 2215/0132* (2013.01)

(58) Field of Classification Search
CPC ..... G03G 2215/00042; G03G 2215/00059; G03G 15/5041; G03G 15/5025; G03G 15/0131; G03G 15/0189; G03G 15/5058
USPC ..... 399/49, 301; 356/445
See application file for complete search history.

(56) References Cited

U.S. PATENT DOCUMENTS 4,796,065 A * 1/1989 Kanbayashi ..... 399/60
6,166,814 A * 12/2000 Pringle ..... 356/445

(Continued)

FOREIGN PATENT DOCUMENTS

JP 7-306556 A 11/1995
JP 2001-109353 A 4/2001

(Continued)

OTHER PUBLICATIONS

International Search Report and Written Opinion mailed Jul. 17, 2012, in International Application No. PCT/JP2012/065174.

(Continued)

*Primary Examiner* — Clayton E LaBalle
*Assistant Examiner* — Trevor J Bervik
(74) *Attorney, Agent, or Firm* — Fitzpatrick, Cella, Harper & Scinto

(57) ABSTRACT

An image forming apparatus includes an image carrier, an image forming unit for forming a patch image on the image carrier, a light emitting unit, a plurality of light receiving units adjacently arranged so as to receive light reflected from the patch image when light is irradiated by the light emitting unit onto the patch image which moves with movement of the image carrier and each including one or more light receiving elements, and an output unit for outputting an output signal that depends on a difference between a received light quantity of a first light receiving unit and a received light quantity of a second light receiving unit that are respectively odd-numbered and even-numbered in the arrangement order of the light receiving units.

12 Claims, 17 Drawing Sheets

(56) References Cited

U.S. PATENT DOCUMENTS

| | | | | |
|---|---|---|---|---|
| 6,816,178 | B2 | 11/2004 | Yamada et al. | |
| 6,853,817 | B2 | 2/2005 | Suzuki | |
| 7,272,333 | B2 * | 9/2007 | Mizes | 399/49 |
| 7,498,578 | B2 * | 3/2009 | Scheuer et al. | 250/341.8 |
| 7,715,740 | B2 | 5/2010 | Hayashihara | |
| 7,715,770 | B2 * | 5/2010 | Kinoshita | 399/301 |
| 7,991,310 | B2 | 8/2011 | Hayashihara | |
| 8,135,294 | B2 | 3/2012 | Hayashihara | |
| 8,260,164 | B2 | 9/2012 | Masuda | |
| 8,564,782 | B2 | 10/2013 | Masuda | |
| 8,787,782 | B2 | 7/2014 | Masuda | |
| 2003/0049039 | A1 | 3/2003 | Suzuki | |
| 2008/0174791 | A1 | 7/2008 | Kudo | |
| 2009/0238590 | A1 * | 9/2009 | Masuda | 399/49 |
| 2010/0266302 | A1 | 10/2010 | Suzuki et al. | |
| 2011/0019044 | A1 * | 1/2011 | Wang et al. | 348/295 |
| 2011/0044713 | A1 * | 2/2011 | Masuda et al. | 399/74 |
| 2013/0156472 | A1 | 6/2013 | Watanabe | |
| 2013/0302048 | A1 | 11/2013 | Sekiguchi et al. | |
| 2013/0302049 | A1 | 11/2013 | Nakagawa et al. | |
| 2013/0302050 | A1 | 11/2013 | Shimba et al. | |
| 2013/0302051 | A1 | 11/2013 | Shimba et al. | |
| 2015/0037057 | A1 | 2/2015 | Masuda | |

FOREIGN PATENT DOCUMENTS

| | | | |
|---|---|---|---|
| JP | 2003-057914 | A | 2/2003 |
| JP | 2003-98798 | A | 4/2003 |
| JP | 2003-162117 | A | 6/2003 |
| JP | 2006-139217 | A | 6/2006 |
| JP | 2008-158110 | A | 7/2008 |
| JP | 2008-199419 | A | 8/2008 |
| JP | 2008-249714 | A | 10/2008 |
| JP | 2008-268172 | A | 11/2008 |
| JP | 2009-186495 | A | 8/2009 |
| JP | 2009-258601 | A | 11/2009 |
| JP | 2010-122463 | A | 6/2010 |
| JP | 2010-152132 | A | 7/2010 |
| JP | 2010-211118 | A | 9/2010 |
| JP | 2011-209686 | A | 10/2011 |

OTHER PUBLICATIONS

Office Action in Japanese Patent Application No. 2011-185258, dated Jun. 5, 2015.

* cited by examiner

IMAGE FORMING APPARATUS HAVING TWO OR MORE LIGHT RECEIVING UNITS

TECHNICAL FIELD

The present invention relates to image forming apparatuses such as copiers, printers and faxes.

BACKGROUND ART

The density characteristics of images printed by an image forming apparatus vary under the influence of factors such as change in the characteristics of components over time, variation in characteristics at the time of manufacture, and the use environment. Japanese Patent Laid-Open No. 2008-249714 discloses a configuration for adjusting density by forming a patch image for detecting density.

In Japanese Patent Laid-Open No. 2008-249714, first, light is irradiated by a light emitting element consisting of an infrared light emitting diode or the like onto a color toner image formed on an intermediate transfer body, and light that is specular reflected at this time is received by a light receiving element for specular reflection, while light that is diffuse reflected is received by a light receiving element for diffuse reflection. Here, the light receiving elements can be constituted by phototransistors, for example. The density of the color toner image is derived from the output of both light receiving elements.

At this time, the infrared light emitting diode and phototransistors are held by being enclosed in packages. Passageways are formed in these packages for securing a light path for light irradiated by the light emitting element to travel to the object being irradiated, and a light path for light specularly reflected by the object being irradiated to travel to the light receiving elements. A passageway for securing a light path for light diffusely reflected by the object being irradiated to travel to the light receiving elements may also be formed in the packages.

With conventionally known sensors for detecting the light quantity of a patch image, it is, for instance, necessary to form light passageways in the packages, as described above, in order to separate specular reflected light and diffuse reflected light, with this being a problem in that it leads to an increase in size of the light quantity detection sensor.

SUMMARY OF INVENTION

The present invention provides an image forming apparatus that prevents from increasing size of the sensor for detecting light quantity in the case of separating specular reflected light and diffuse reflected light in association with patch image detection.

An image forming apparatus includes an image carrier; an image forming means for forming a patch image on the image carrier; a light emitting means; a plurality of light receiving means adjacently arranged so as to receive light reflected from the patch image when light is irradiated by the light emitting means onto the patch image which moves with movement of the image carrier, and each including one or more light receiving elements; and an output means for outputting an output signal that depends on a difference between a received light quantity of a first light receiving means and a received light quantity of a second light receiving means that are respectively odd-numbered and even-numbered in an arrangement order of the light receiving means.

Further features of the present invention will become apparent from the following description of exemplary embodiments with reference to the attached drawings.

DESCRIPTION OF EMBODIMENTS

First Embodiment

Figure 1:
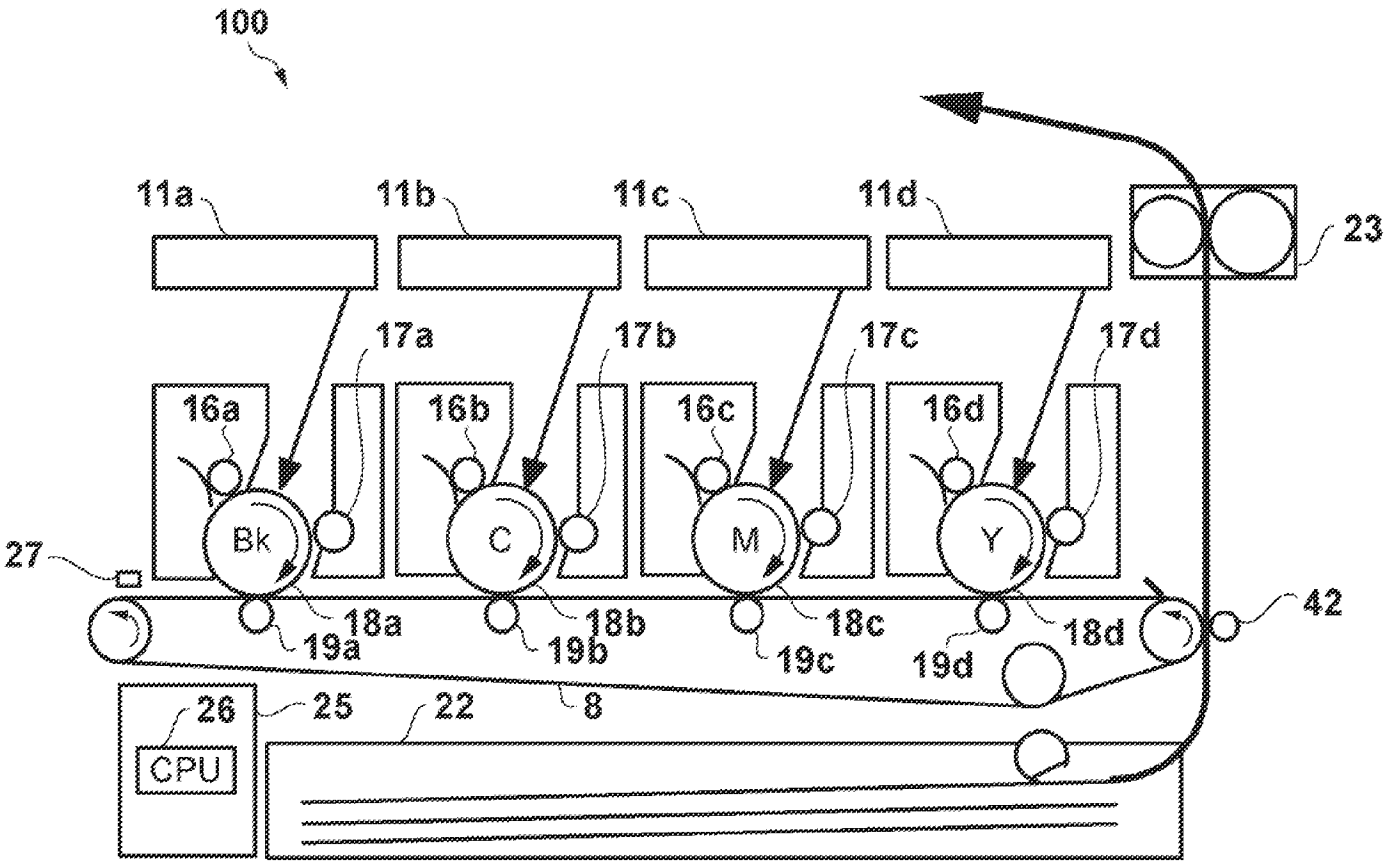
FIG. 1 is a diagram showing a configuration of an image forming apparatus according to an embodiment.

First, an image forming unit of an image forming apparatus according to the present embodiment will be described using FIG. 1. In FIG. 1, a charging unit 16*a* uniformly charges a photosensitive member 18*a* serving as an image carrier, and an exposure unit 11*a* irradiates the photosensitive member 18*a* with a laser beam and forms an electrostatic latent image. A developing unit 17*a* develops the electrostatic latent image on the photosensitive member 18*a* with black toner to form a toner image. A primary transfer unit 19*a* transfers the toner image on the photosensitive member 18*a* to an intermediate transfer belt 8 serving as an image carrier. In other words, a toner image is formed on an image carrier. Note that exposure units 11*b* to 11*d*, charging units 16*b* to 16*d*, developing units 17*b* to 17*d*, photosensitive members 18*b* to 18*d*, and primary transfer units 19*b* to 19*d* are respectively for forming cyan, magenta and yellow toner images on the intermediate transfer belt 8. The toner images of the different colors may be superimposed on the intermediate transfer belt 8.

A secondary transfer unit 42 transfers the toner images on the intermediate transfer belt 8 to recording material from a cassette 22. A fixing unit 23 applies heat and pressure to the toner images transferred to the recording material to fix the toner images to the recording material. Also, a control unit 25 is provided with a CPU 26, with the CPU 26 performing overall control of the image forming apparatus, such as control relating to image formation and control relating to fault detection.

Furthermore, the image forming apparatus is provided with a sensor 27 that detects the density of a patch image for density control or the like formed on the intermediate transfer belt 8 by the image forming unit, and detects a patch image for color shift correction formed on the intermediate transfer belt 8. Note that the data of the patch images for density control and color shift correction to be formed is preset in a storage unit of the image forming apparatus (not shown). Toner images (patch images) are formed by the image forming unit in accordance with this patch image data.

Also, the control unit 25 receives an output signal of the sensor 27, and automatically performs maximum density correction and intermediate density correction. Note that the maximum density correction is performed by changing process conditions (image forming conditions) such as developing bias and charging bias. Also, the intermediate density correction is correction (so-called gamma correction) for ensuring that image signals and image density are in a linear relationship (image forming condition). Note that the control unit 25 executes density correction in the case where a prescribed condition is met, such as when a predetermined number of sheets have been printed, when power is turned on, or when the image forming apparatus receives input from the user instructing that density correction be performed.

Note that although a tandem image forming apparatus using the intermediate transfer belt 8 is given as an exemplary image forming apparatus in the following description, the present invention is not limited to this system of image forming apparatus. For example, the image forming apparatus may be a device that transfers toner images formed on a plurality of photosensitive members directly to recording material. In this case, a recording material conveyance member (recording material carrier) that conveys recording material is targeted for patch image formation, and functions as an image carrier. Furthermore, the image forming apparatus may be a rotary device constituted by a single photosensitive member. Furthermore, the image forming apparatus may be configured to detect the toner density of a patch image formed on a photosensitive member.

Figure 2:
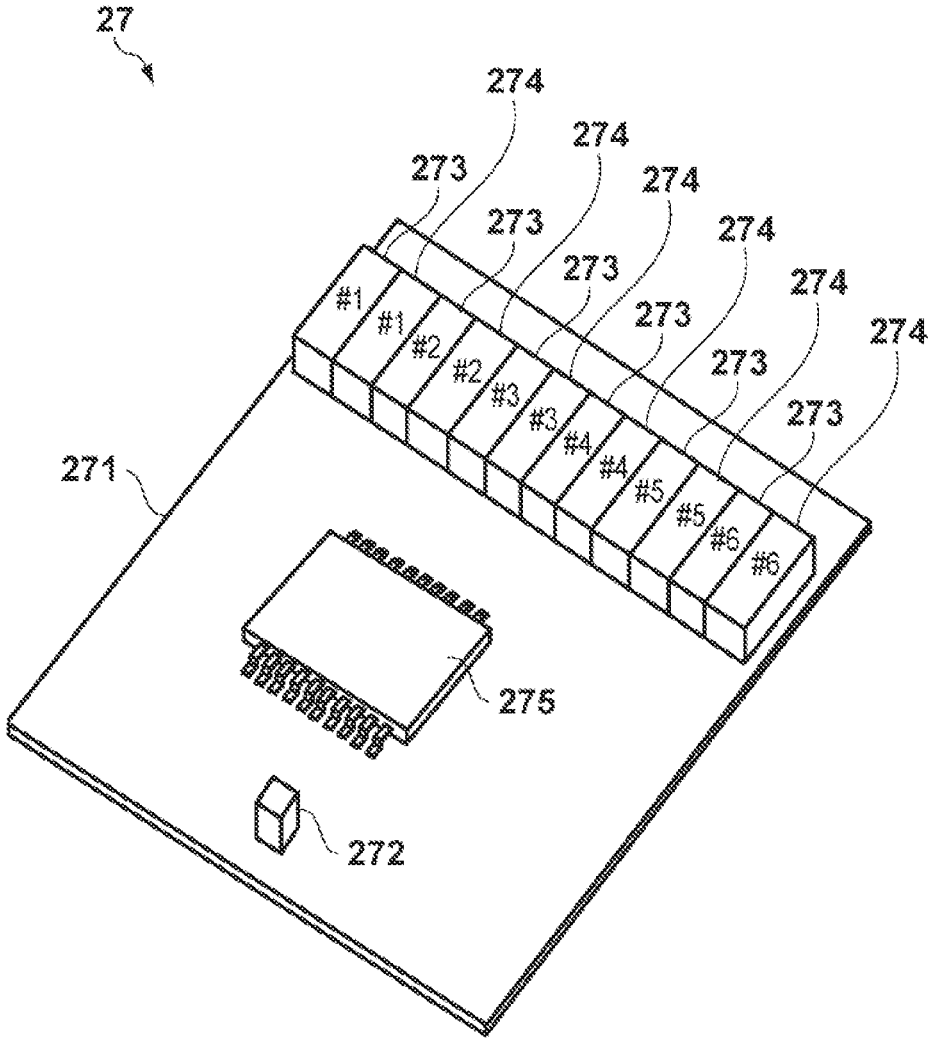
FIG. 2 is a perspective view showing a configuration of a sensor according to an embodiment.

The sensor 27 of the present embodiment is configured by disposing a light emitting element 272, light receiving elements 273 and 274, and a control IC 275 having a control circuit formed therein on the same surface of a substrate 271, as shown in FIG. 2. Note that the control IC 275 is electrically connected to the CPU 26 directly or via a signal forming circuit such as a rectifying circuit 251 (discussed later). The light emitting element 272 is an LED, for example, and the light receiving elements 273 and 274 are photodiodes or phototransistors, for example, and are arranged so as to be capable of receiving reflected light from the light emitting element 272. In the present embodiment, the light receiving elements 273 and 274 are arranged at an equal pitch, and the numbers of light receiving elements 273 and 274 are the same. In other words, an even number (of two or more) of light receiving elements is used. Note that the light receiving elements 273 (first light receiving unit), which are arranged in odd-numbered positions in order of arrangement in the array direction, and the light receiving elements 274 (second light receiving unit), which are arranged in even-numbered positions, respectively form one group. In the following description, it is assumed that six light receiving elements 273 and six light receiving elements 274 are used. Note that, in the drawings, #1 to #6 displayed on the light receiving elements 273 and 274 are the numbers of the light receiving elements 273 and 274.

Figure 3:
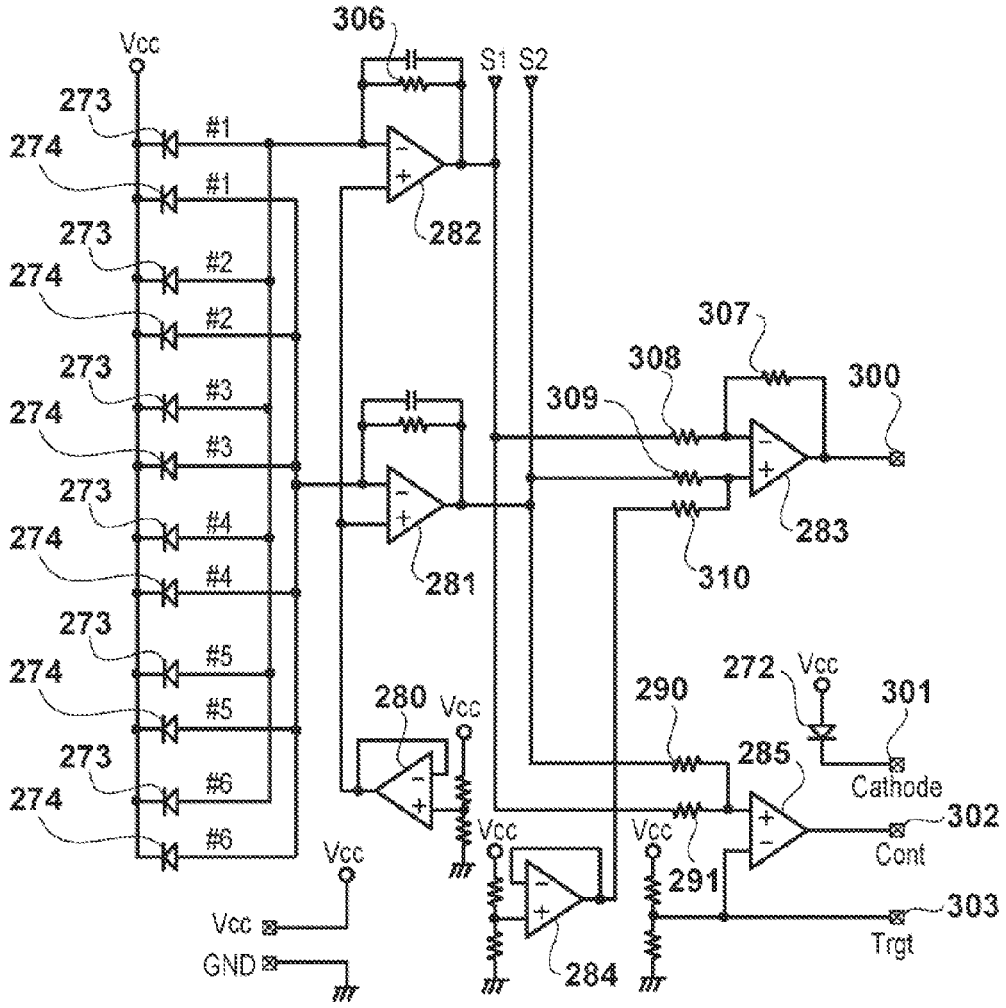
FIG. 3 is a circuit diagram of a sensor according to an embodiment.

FIG. 3 is a diagram showing the circuitry of the control IC 275 and the electrical connection between the light emitting element 272 and the light receiving elements 273 and 274. A reference voltage is input from a voltage follower element 280 to non-inverting input terminals of I-V conversion amplifiers 281 and 282 serving as operational amplifiers. Each light receiving element 273 outputs a current corresponding to a received light quantity to an inverting input terminal of the I-V conversion amplifier 282. Since the impedance of the inverting input terminal and the non-inverting input terminal of an ideal operational amplifier is infinite, the current corresponding to the total received light quantity of the six light receiving elements 273 will flow to a resistor 306 connected between the inverting input terminal and the output terminal of the I-V conversion amplifier 282. Also, the inverting input terminal and the non-inverting input terminal of the ideal operational amplifier (I-V conversion amplifier) 282 are virtually short-circuited and potentials thereof are approximately equal. Therefore, in the case where none of the six light receiving elements 273 are receiving light, the output of the I-V conversion amplifier 282 will equal the reference voltage, since current does not flow to the resistor 306 and there is no voltage drop caused by the resistor 306.

In contrast, the current flowing to the resistor 306 also increases as the total received light quantity of the light receiving elements 273 increases, and therefore the amount of voltage drop in the resistor 306 also increases. Accordingly, with the configuration in FIG. 3, an output voltage S1 (hereinafter referred to as voltage S1) of the I-V conversion amplifier 282 will decrease as the total received light quantity of the six light receiving elements 273 increases. Note that a capacitor connected between the inverting input terminal and the output terminal of the I-V conversion amplifier 282 is for phase compensation and denoising. Similarly, an output voltage S2 (hereinafter referred to as voltage S2) of the I-V conversion amplifier 281 will decrease as the total received light quantity of the six light receiving elements 274 increases. Note that although the light receiving elements 273 are each electrically connected to the I-V conversion amplifier 282 and the light receiving elements 274 are each electrically connected to the I-V conversion amplifier 281 in FIG. 3, it is clear that even in the case where this correspondence relationship is reversed, the sensor will operate so as to obtain similar effects.

The voltage S1 is input to the inverting input terminal of a differential amplifier 283 serving as an operational amplifier constituting a subtraction circuit together with resistors 307 to 310, and the voltage S2 is input to the non-inverting input terminal of the differential amplifier 283. An analog reference voltage Vref output by a voltage follower element 284 is input to the non-inverting input terminal of the differential amplifier 283. Let the output voltage of the voltage follower element 284 be Vref, the resistance values of the resistors 308, 307, 309 and 310 respectively be R308, R307, R309 and R310, and the output of the differential amplifier 283 be Sout. Then, Sout is represented by the following equation (1), when R308=R309 and R307=R310, for example:

$$Sout=(S2-S1)\times(R307/R308)+Vref. \quad (1)$$

Accordingly, the output of the differential amplifier 283 equals the analog reference voltage Vref when the voltage S1 and the voltage S2 are equal. Also, the output of the differential amplifier 283 is higher than the analog reference voltage Vref in the case where the voltage S1 is lower than the voltage S2, and is lower than the analog reference voltage Vref in the case where the voltage S1 is higher than the voltage S2. Note that the voltages S1 and S2 respectively decrease when the received light quantity of the light receiving elements 273 and 274 increases. In this way, the output of the differential amplifier 283 is higher than the analog reference voltage Vref in the case where the received light quantity of the light receiving elements 273 is greater than that of the light receiving elements 274, and is lower than the analog reference voltage Vref in the case where the received light quantity of the light receiving elements 273 is lower than that of the light receiving elements 274. The difference between the output of the differential amplifier 283 and the analog reference voltage Vref increases as the difference between the received light quantity of the light receiving elements 273 and the received light quantity of the light receiving element 274 increases. The output of the differential amplifier 283 is output from a terminal 300 to the outside of the control IC 275. In this way, the control IC 275 constitutes an output unit that outputs a signal (=Sout) that depends on the difference between the total received light quantity of the light receiving elements 273 and the total received light quantity of the light receiving elements 274.

Note that a voltage obtained by adding the voltage S1 and the voltage S2 and voltage-dividing the result with the resistor 290 and the resistor 291 is input to the non-inverting input terminal of a differential amplifier 285. Here, the resistance values of the resistor 290 and the resistor 291 are equal. This enables an output ((S1+S2)/2) equivalent to the total received light quantity of the light receiving elements 273 and 274 to then be detected, by short-circuiting a terminal 302 connected to the output of the differential amplifier 285 and a terminal 303 connected to the inverting input terminal of the differential amplifier 285. This is used for measuring and adjusting the light quantity of the light emitting element 272. Note that a terminal 301 is used in adjusting the light quantity of the light emitting element 272. For example, in response to a drop in the light quantity of the light emitting element 272 due to prolonged use, light emission intensity can be adjusted by detecting the total received light quantity of the light receiving elements 273 and 274 when the intermediate transfer belt 8 is irradiated with light, and using this to adjust the voltage applied to the terminal 301. Adjustment of the light quantity of the light emitting element 272 is executed by the control unit 25, for example, before detecting reflected light from a patch image 81 in the density control processing, for example. In other words, the control unit 25 also functions as a light quantity control unit.

Figure 4A:
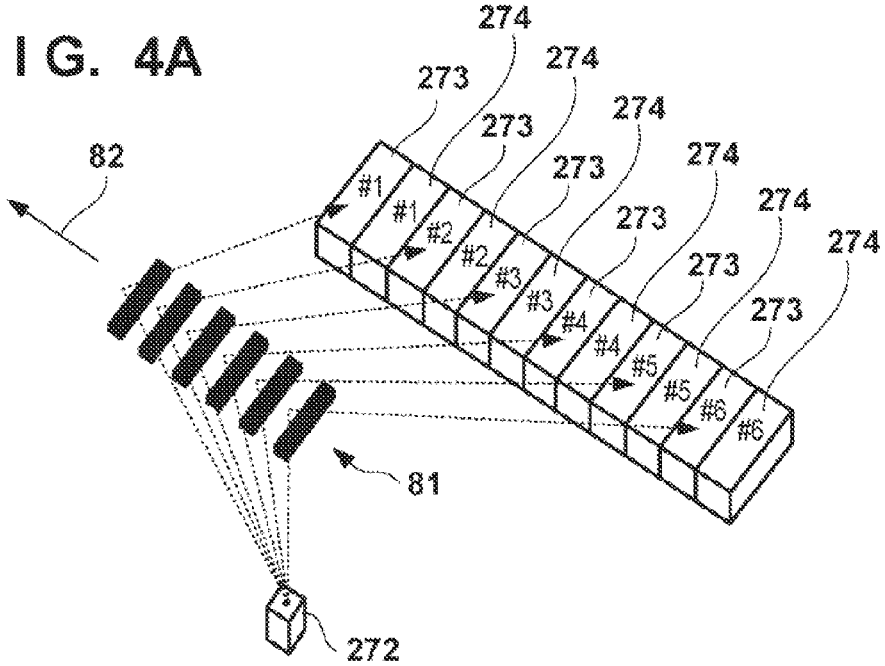
FIGS. 4A and 4B are diagrams illustrating reception of specular reflected light from a patch image according to an embodiment.
Figure 4B:
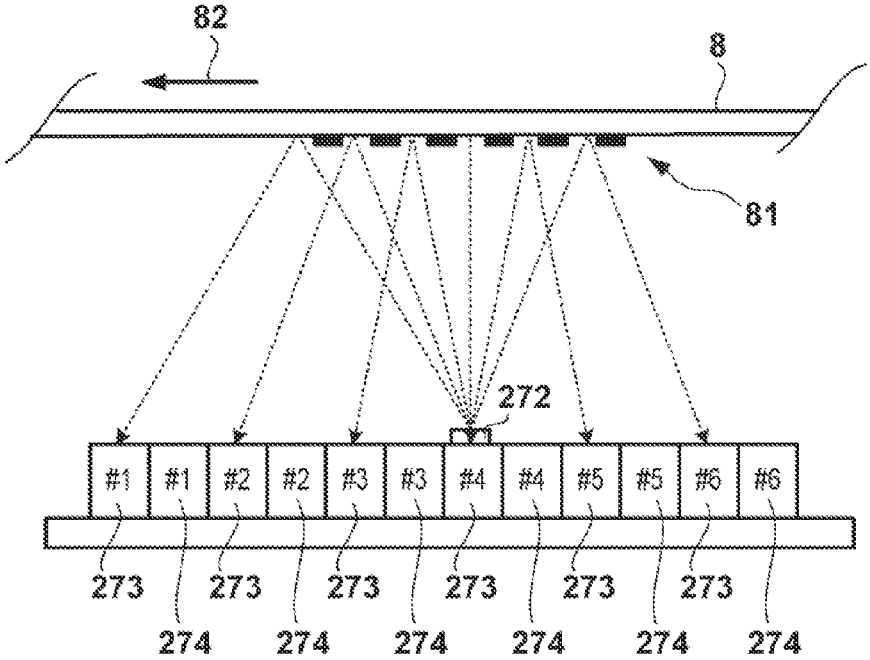

Next, reception by the sensor 27 of specular reflected light from the patch image 81 formed on the intermediate transfer belt 8 will be described using FIGS. 4A and 4B. Note that, in FIG. 4A, the control IC 275 and the substrate 271 are omitted for simplification. Also, in FIG. 4A, the arrow denoted by reference numeral 82 indicates the movement direction of the intermediate transfer belt 8. As shown in FIG. 4A, in the present embodiment, the patch image 81 is an image including a plurality of lines formed by toner perpendicular to the movement direction of the intermediate transfer belt 8 and at an equal pitch in the movement direction.

Figure 5:
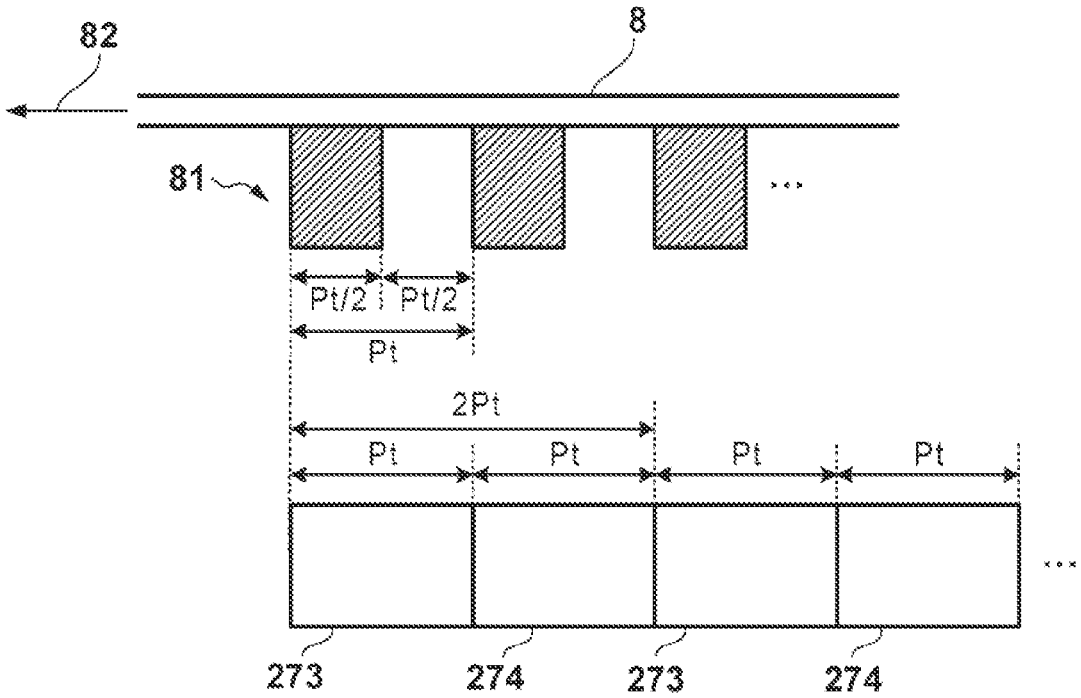
FIG. 5 is a diagram showing the relationship between the pitch of light receiving elements of a sensor and the pitch of lines of a patch image according to an embodiment.

As shown in FIG. 4A, diffused light irradiated between the toner lines of the patch image 81 from the light emitting element 272 is specular reflected. In the present embodiment, as shown in FIG. 5, the pitch between adjacent toner lines (toner portions) of the patch image 81 is Pt, and the pitch of the light receiving elements 273 and 274 in the movement direction 82 is 2Pt, which is twice the pitch of the toner portions. Note that in all of the embodiments, the pitch of the toner portions, as shown in FIG. 5, denotes the distance between a position of one toner portion and a corresponding position of a toner portion adjacent thereto, and does not denote the width of portions without toner (toner-less portions). Note that, in the present embodiment, as shown in FIG. 5, the widths of the toner portions and the toner-less portions are set equally to Pt/2. Similarly, in all of the embodiments, the pitch of adjacent light receiving elements, as shown in FIG. 5, denotes the distance between a position of one light receiving element and a corresponding position of an adjacent light receiving element having the same reference sign, when distinguishing between the light receiving elements 273 and 274. In the present embodiment, as shown in FIG. 5, the pitches of the light receiving elements 273 and 274 are set equally to 2Pt, and the widths of the light receiving elements 273 and 274 are set equally to Pt.

Since the angle of incidence and angle of reflection of specular reflected light on the reflection surface are equal, light reflected between the toner portions of the patch image 81 will, according to this configuration, be incident on only the light receiving elements 273 or 274, depending on the position of the patch image 81. FIG. 4A shows incidence of specular reflected light on only the light receiving elements 273. Note that incidence of specular reflected light on only the light receiving elements 273 referred to here also includes the case where specular reflected light is approximately incident on only the light receiving elements 273 or the light receiving elements 274. FIG. 4B is a diagram in which, like FIG. 4A, incidence of specular reflected light on only the light receiving elements 273 is shown, as viewed from a direction perpendicular to the movement direction of the intermediate transfer belt 8 and to a plane including the normal direction of the substrate 271.

Figure 6A:
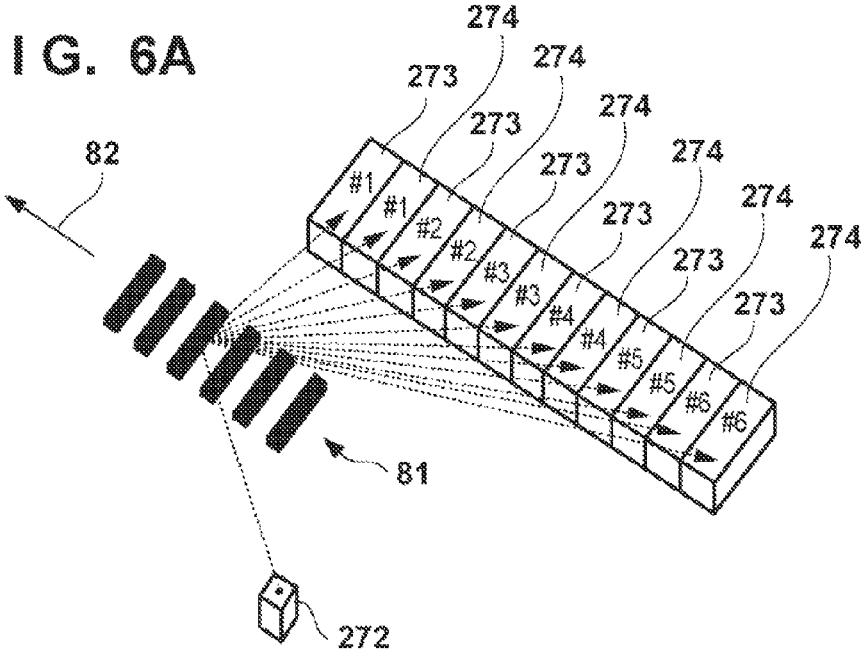
FIGS. 6A and 6B are diagrams illustrating reception of diffuse reflected light from a patch image according to an embodiment.
Figure 6B:
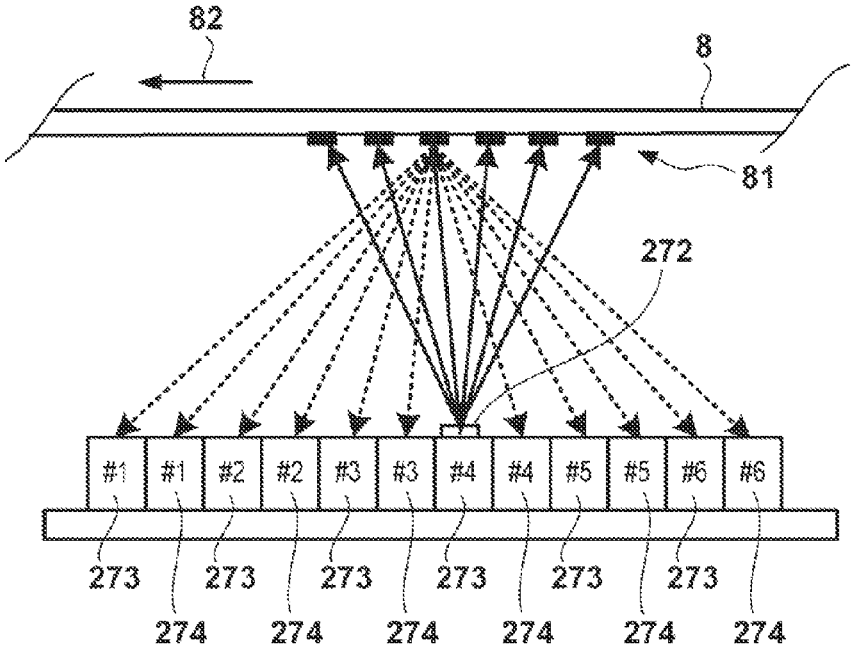

On the other hand, light irradiated onto the toner portions of the patch image 81 by the light emitting element 272 is diffuse reflected. Accordingly, as shown in FIG. 6A, light reflected by the toner portions is incident approximately uniformly on all of the light receiving elements 273 and 274. Note that the control IC 275 and the substrate 271 have also been omitted for simplification in FIG. 6A. Also, although FIG. 6A shows only diffuse reflected light from one line portion of the patch image 81, in actual fact, diffuse reflected light from each line portion is incident on the light receiving elements 273 and 274. FIG. 6B is a diagram in which, like FIG. 6A, incidence of diffuse reflected light on all of the light receiving elements 273 is shown, as viewed from a direction perpendicular to the movement direction of the intermediate transfer belt 8 and to a plane including the normal direction of the substrate 271.

Figure 7:
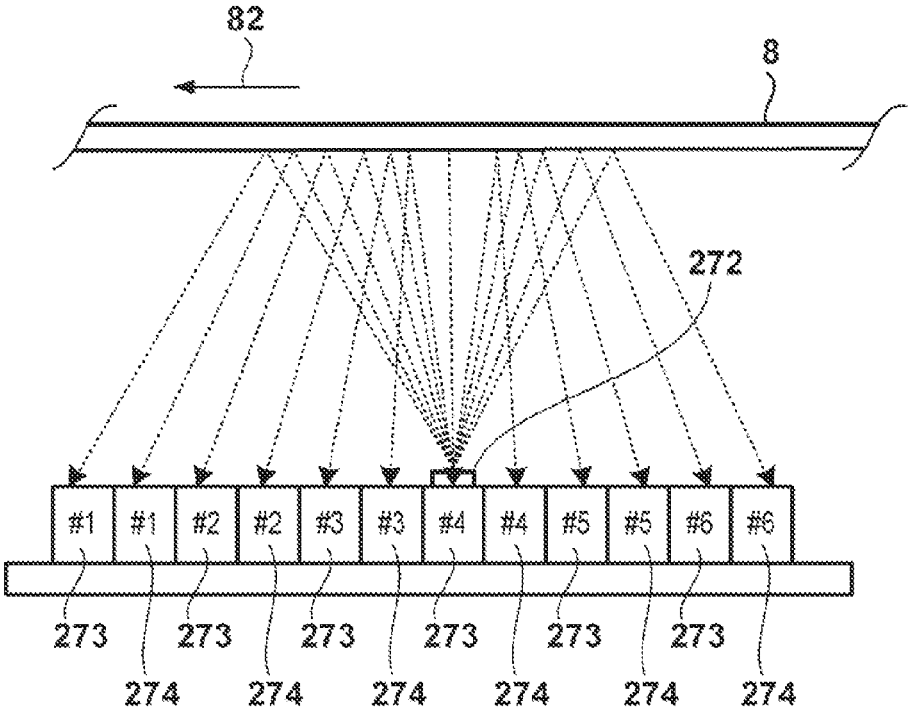
FIG. 7 is a diagram illustrating reception of reflected light from an area in which a patch image is not formed according to an embodiment.

Also, in areas in which the patch image 81 is not formed, specular reflected light reflected by the surface of the intermediate transfer belt 8 will be incident on all of the light receiving elements 273 and 274. This is shown in FIG. 7. In this way, both the light receiving elements 273 and 274 receive diffuse reflected light from the patch image. Also, specular reflected light from the patch image is received by either the light receiving elements 273 or 274 according to the position of the patch image.

Accordingly, when the patch image 81 is outside the detection range of the sensor 27, specular reflected light reflected by the surface of the intermediate transfer belt 8 is incident on each of the light receiving elements 273 and 274 of the sensor 27. In this case, the voltages S1 and S2 of FIG. 3 are equal, and, therefore, the output of the sensor 27 will be equal to the analog reference voltage Vref.

In contrast, since light reflected by the toner-less portions is, depending on the position of the patch image 81, incident on only the light receiving elements 273 or 274 when the patch image 81 enters the detection range of the sensor 27, the voltage S1 and S2 will no longer be equal. Since the reflection position of reflected light from the toner-less portions changes due to movement of the patch image 81, the light receiving state changes alternately between the light receiving elements 274 receiving specular reflected light and the light receiving elements 273 receiving specular reflected light. In other words, the magnitude relationship between the voltage S1 and the voltage S2 will change alternately when the patch image 81 is within the detection range of the sensor 27. Therefore, in the case where the patch image 81 is within the detection range of the sensor 27, the output of the sensor 27 will oscillate around the analog reference voltage Vref.

Figure 8:
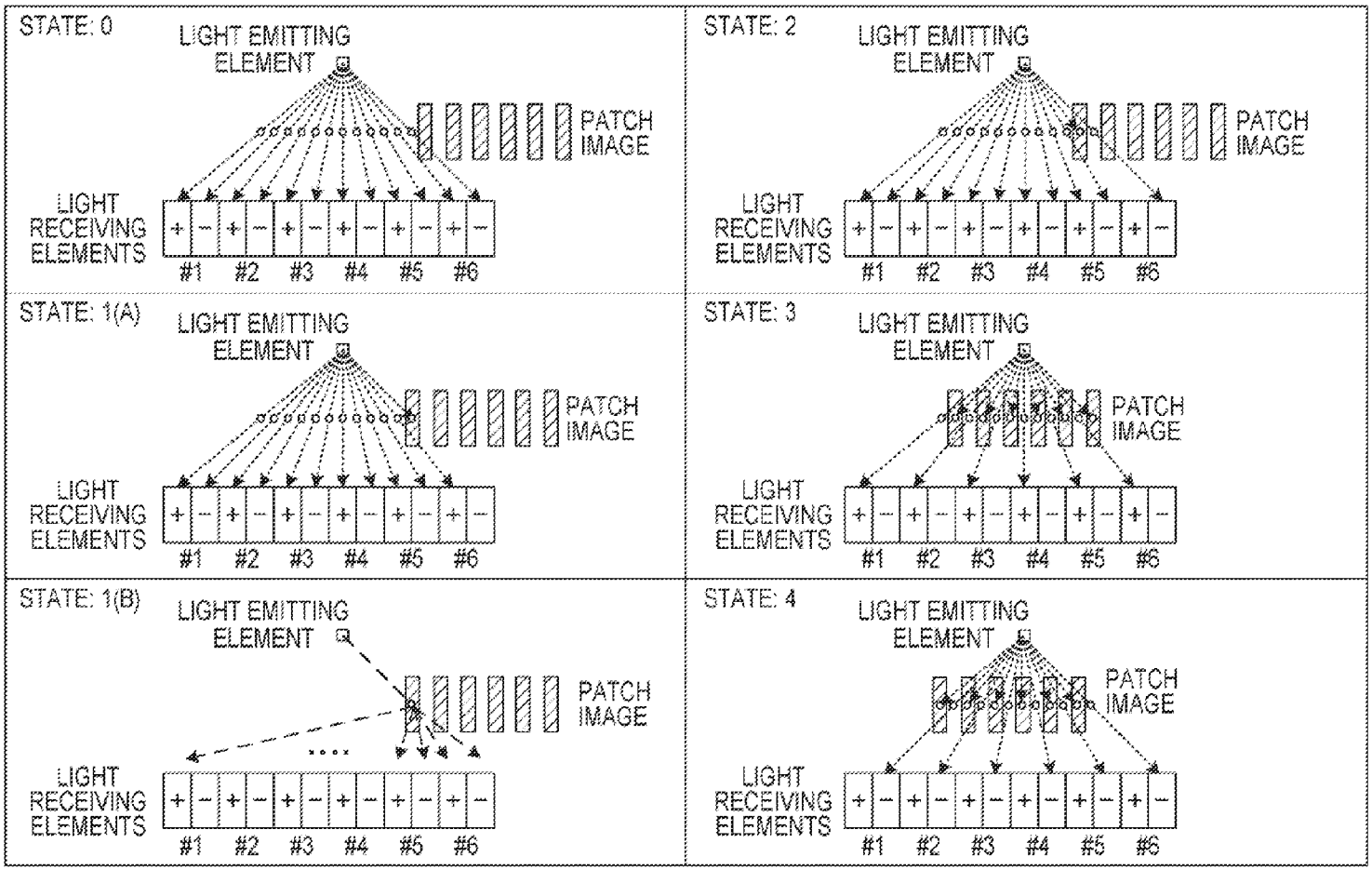
FIG. 8 is a diagram for describing output waveforms of a sensor according to an embodiment.
Figure 9:
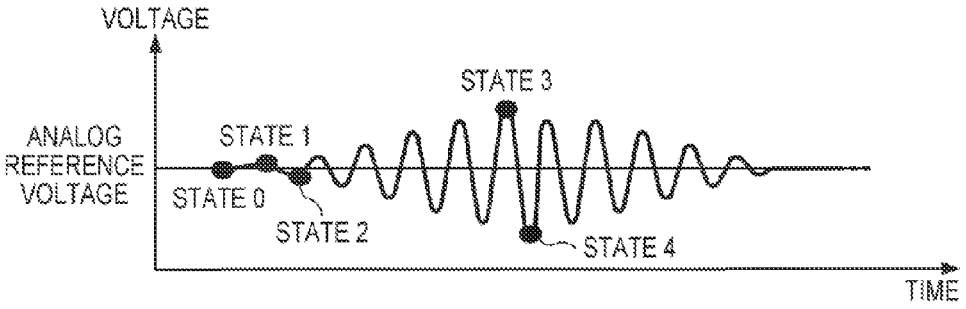
FIG. 9 is a diagram showing an output waveform of a sensor according to an embodiment.

The above contents will be described more specifically using FIG. 8 and FIG. 9. Note that the light receiving elements shown with a "+" sign in FIG. 8 are light receiving elements 273, and the light receiving elements shown with a "−" sign are light receiving elements 274. Also, the number of each light receiving element is shown below the light receiving elements. Furthermore, the patch image 81 is assumed to move in the direction of the left side in the diagram.

State 0: State 0 is a state in which each light receiving element receives only specular reflected light from an area in which the patch image 81 on the intermediate transfer belt 8 is not formed. Here, the circle mark on the dotted line of the arrows is the reflection point on the intermediate transfer belt 8. At this time, the total received light quantities of the light receiving elements 273 and the light receiving elements 274 are equal, and, therefore, the output of the sensor 27 will be equal to the analog reference voltage Vref denoted by "State 0" in FIG. 9.

State 1: State 1 is a state in which the toner portion at the head of the patch image 81 reaches the reflection point of specular reflected light to the #6 light receiving element 274. As shown in state 1(A), all of the light receiving elements other than the #6 light receiving element 274 receive specular reflected light. Also, as shown in state 1(B), each light receiving element receives diffuse reflected light from the toner portion at the head of the patch image 81. Therefore, the #6 light receiving element 274 will receive only diffuse reflected light, and not specular reflected light. On the other hand, the other light receiving elements all receive specular reflected light and diffuse reflected light, so the total received light quantity of the light receiving elements 273 will be greater than the total received light quantity of the light receiving elements 274. Therefore, the output of the sensor 27 will be a higher voltage than the analog reference voltage Vref denoted by "State 1" in FIG. 9.

State 2: State 2 is a state in which the toner portion at the head of the patch image 81 reaches the reflection point of specular reflected light to the #6 light receiving element 273. As shown in the diagram, in state 2, all of the light receiving elements 274 and the light receiving elements 273 other than #6 receive specular reflected light, but the #6 light receiving element 273 no longer receives specular reflected light. Also, diffuse reflected light is substantially uniformly incident on the light receiving elements 273 and 274. Accordingly, the total received light quantity of the light receiving elements 273 will be less than the total received light quantity of the light receiving elements 274. Therefore, the output of the sensor 27 will be a lower voltage than the analog reference voltage Vref, as denoted by "State 2" in FIG. 9.

State 3: State 3 is a state in which the toner-less portions of the patch image 81 are at the reflection points of specular reflected light to the light receiving elements 273. In other words, the toner portions of the patch image 81 are at the reflection points of specular reflected light to the light receiving elements 274. In this case, all of the light receiving elements 274 will receive only diffuse reflected light, and not specular reflected light. In contrast, all of the light receiving elements 273 will receive specular reflected light as shown by the dotted-line arrows, in addition to diffuse reflected light. Therefore, the total received light quantity of the light receiving elements 273 is greater than the total received light quantity of the light receiving elements 274, with the difference therebetween being maximized. Therefore, the output of the sensor 27 will be the maximum voltage, as denoted by "State 3" in FIG. 9.

State 4: State 4 is a state in which the toner-less portions of the patch image 81 are at the reflection points of specular reflected light to the light receiving elements 274. In other words, the toner portions of the patch image 81 are the reflection points of specular reflected light to the light receiving elements 273. In this case, all of the light receiving elements 273 will receive only diffuse reflected light, and not specular reflected light. In contrast, all of the light receiving elements 274 will receive specular reflected light as shown by the dotted-line arrows in the diagram, in addition to diffuse reflected light. Therefore, the total received light quantity of the light receiving elements 274 is greater than the total received light quantity of the light receiving elements 273, with the difference therebetween being maximized. Therefore, the output of the sensor 27 will be the minimum voltage, as denoted by "State 4" in FIG. 9.

Thereafter, in accordance with movement of the patch image 81, the magnitude relationship between the total received light quantities of the light receiving elements 273 and the light receiving elements 274 is reversed, and the difference therebetween decreases. Therefore, as the output of the sensor 27 oscillates between positive and negative based on the analog reference voltage Vref, the absolute value thereof becomes smaller, as shown in FIG. 9. Here, the maximum amplitude of the sensor 27 will change according to the proportion (toner distribution rate) of toner in the toner portions of the patch image 81. Referring to the circuit of FIG. 3, the influence of diffuse reflected light is canceled by the differential amplifier 283 irrespective of light quantity. On the other hand, with regard to specular reflected light, the output of the sensor 27 will change according to the difference in reflected light quantity between the patch image portion and the intermediate transfer belt.

Figure 10:
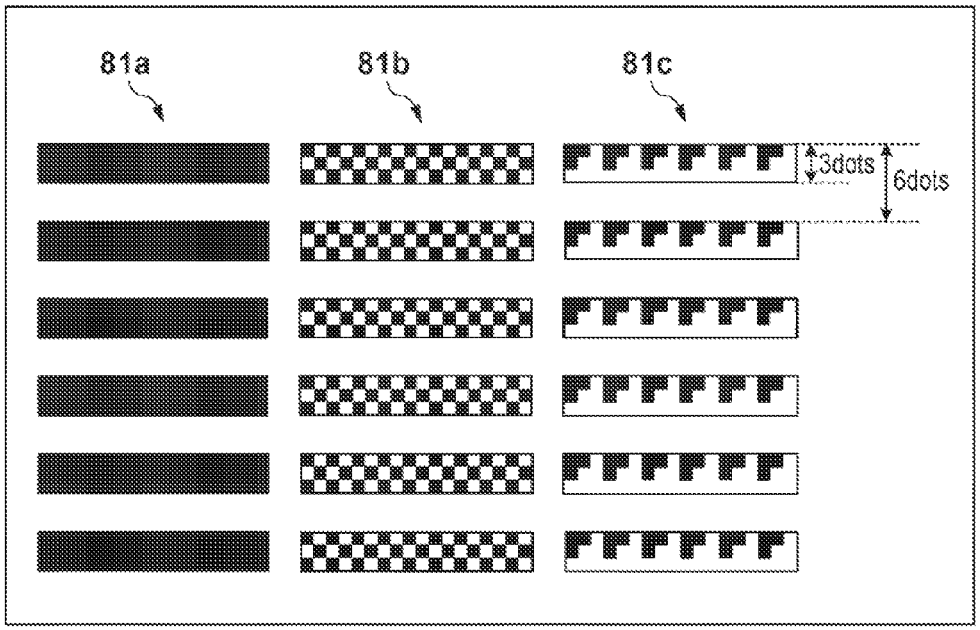
FIG. 10 is a diagram showing patch images according to an embodiment.
Figure 11:
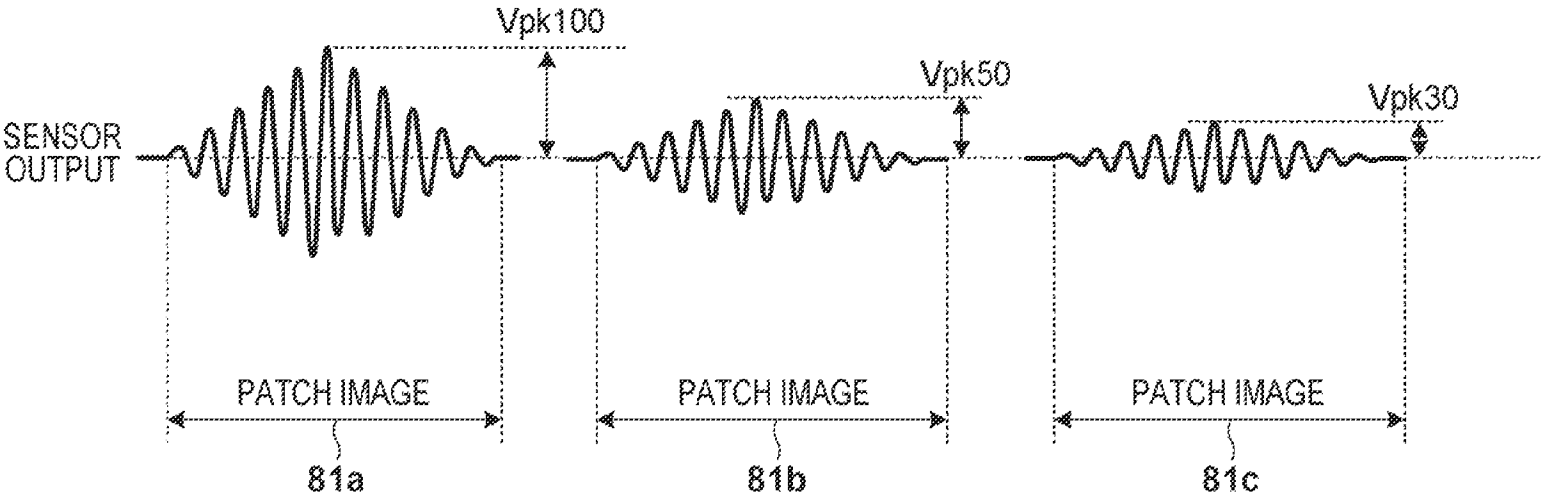
FIG. 11 is a diagram showing output waveforms of a sensor relative to patch images according to an embodiment.

FIG. 10 shows patch images 81*a*, 81*b*, and 81*c* in which the toner distribution rates of the toner portions are respectively 100%, 50% and 30%. Note that the patch images 81*a*, 81*b* and 81*c* all have toner portions with a 3-dot width and toner-less portions with a 3-dot width. Vpk100, Vpk50 and Vpk30 in FIG. 11 are the respective maximum outputs of the sensor 27 when the patch images 81*a*, 81*b* and 81*c* are used. As shown in FIG. 11, Vpk50 and Vpk30 are respectively 50% and 30% of Vpk100, and a value corresponding to the toner distribution rate of the toner portions of the patch image 81 is output from the sensor 27.

Figure 12A:
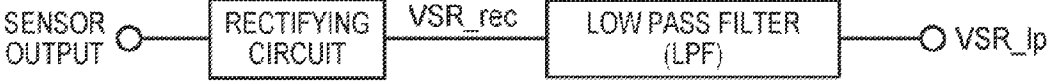
FIG. 12A is a block diagram of a control unit according to an embodiment.
Figure 12B:
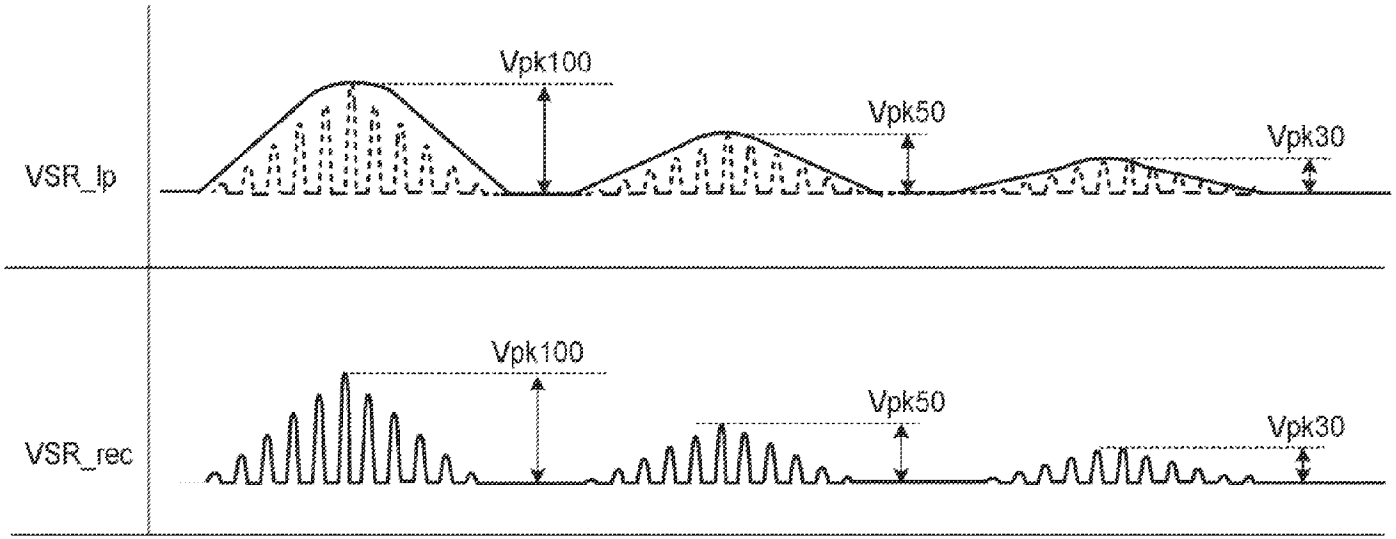
FIG. 12B is a diagram showing waveforms of the components in FIG. 12A.

The signal output by the sensor 27 is input to the control unit 25 of FIG. 1. The control unit 25 also serves as a determination unit that determines the density of the patch image 81 from the peak value of the output signal of the sensor 27. Also, when there is no linearity in the relationship between peak value and density, the control unit 25 holds a table in which peak values and densities are associated or an arithmetic equation, and derives the density from the peak value as appropriate. Also, the control unit 25 may directly adjust the various image forming conditions based on the peak value, or adjust gamma correction (one of the image forming conditions), without deriving the density. The control unit 25 also serves as a determination unit that determines the position of the patch image 81 from the timing at which the peak value of the output signal of the sensor 27 is generated. Color shift correction can be performed by comparing the timings at which the peak values of the different colors are generated, and performing adjustment to obtain a desired relationship. As shown in FIG. 12A, the control unit 25 rectifies the output signal from the sensor 27 with the rectifying circuit 251, and performs waveform shaping with a low pass filter 252. The output of the low pass filter 252 is connected to an analog detection terminal of the CPU 26, undergoes analog-to-digital conversion in the CPU 26, and is imported as density data. An output signal VSR_rec of the rectifying circuit 251 and an output signal VSR_lp of the low pass filter 252 are shown in FIG. 12B. Note that it is possible to simply measure only the peak value (p-p or 0-p) of the output signal of the sensor 27. Also, a configuration may be adopted in which the control unit 25 determines whether the output signal VSR_lp exceeds or falls below a threshold, as the method by which the position of the patch image 81 is determined.

Note that if the toner portions of the patch image 81 are doubled in number without changing the pitch thereof in the movement direction of the patch image 81, peak values will be continuously output from the sensor 27. If the CPU 26 is configured to determine the peak value with, for example, an average value of the continuously output peak values, peak value detection accuracy can be further improved.

As described above, in the present embodiment, diffuse reflected light is commonly incident on all of the light receiving elements 273 and 274, and diffuse reflected light input to both groups of light receiving elements is processed by a differential circuit within the sensor 27. Accordingly, the control unit 25 is able to take the output of the differential circuit as the variation in light quantity of specular reflected light, without needing to perform correction processing or the like on diffuse reflected light. In other words, if the change in specular reflected light respectively received by the light receiving elements 273 and 274 from toner-less portions due to movement of the patch image 81 differs between the light receiving elements 273 and 274, the density of the patch image can be determined from the difference in received light quantity between the light receiving elements 273 and 274. Thereby, the problem of the increased size of the sensor for detecting light quantity can be solved, in the case of separating specular reflected light and diffuse reflected light in association with patch image detection.

Furthermore, the patch image 81 may be a repetitive pattern of 6 dots in total consisting of toner portions having a 3-dot width and toner-less portions having a 3-dot width, so even if the pattern is repeated six times, a single patch image 81 having a total width of 36 dots can be formed. In the conventional technology, the size of the patch image 81 for density detection is dependent on the spot diameter of the light emitting element 272, and with a 600 dpi printer, for example, a patch image of around 150 to 200 dots in size was required. Accordingly, the amount of toner consumption can also be reduced in comparison to the conventional technology. Therefore, cleaning toner on the intermediate transfer belt 8 is facilitated, and miniaturization of the waste toner box for collecting waste toner after cleaning can be anticipated. Also, the light emission quantity of the light emitting element 272 can be suppressed, by disposing the light receiving elements 273 and 274 in an array. Also, the configuration is simplified since the spot diameter of the light emitting element 272 does not need to be narrowed down.

Note that although FIG. 3 was described in the case of the gains of the I-V conversion amplifiers 281 and 282 being the same and the numbers of light receiving elements 273 and 274 being the same, the present invention is not limited to such a configuration. For example, in the case where the gain of the I-V conversion amplifier 281 is twice that of the I-V conversion amplifier 282, the number of light receiving elements 274 connected to the I-V conversion amplifier 281 may be halved. It is clear that similar effects are also obtained by thus varying the configuration.

Also, although six light receiving elements 273 and 274 each were used in the abovementioned embodiment, the present invention is not limited thereto. For example, in the case where sufficient reflected light quantity is obtained for density control, it is possible to use arbitrary pairs of light receiving elements 273 and 274, such as being able to use only one pair of light receiving elements 273 and 274. Also, the number of toner portions of the patch image 81 is not limited to six. For example, in the case of using one pair of light receiving elements 273 and 274, the patch image 81 can be composed of one toner portion. A difference in output between the light receiving elements 273 and 274 with movement of the patch image 81 also occurs in this case, enabling density and the like to be detected from this difference. In other words, a waveform output of one cycle including state 3 and state 4 in FIG. 9 will be obtained in the case where sufficient reflected light quantity is obtained, with the amplitude of this waveform representing the density of the patch image. The effect of cancelling the influence of diffuse reflected light can also be obtained in this case, and the problem of the increased size of the light quantity detection sensor associated with separating specular reflected light and diffuse reflected light can be solved.

Figure 13:
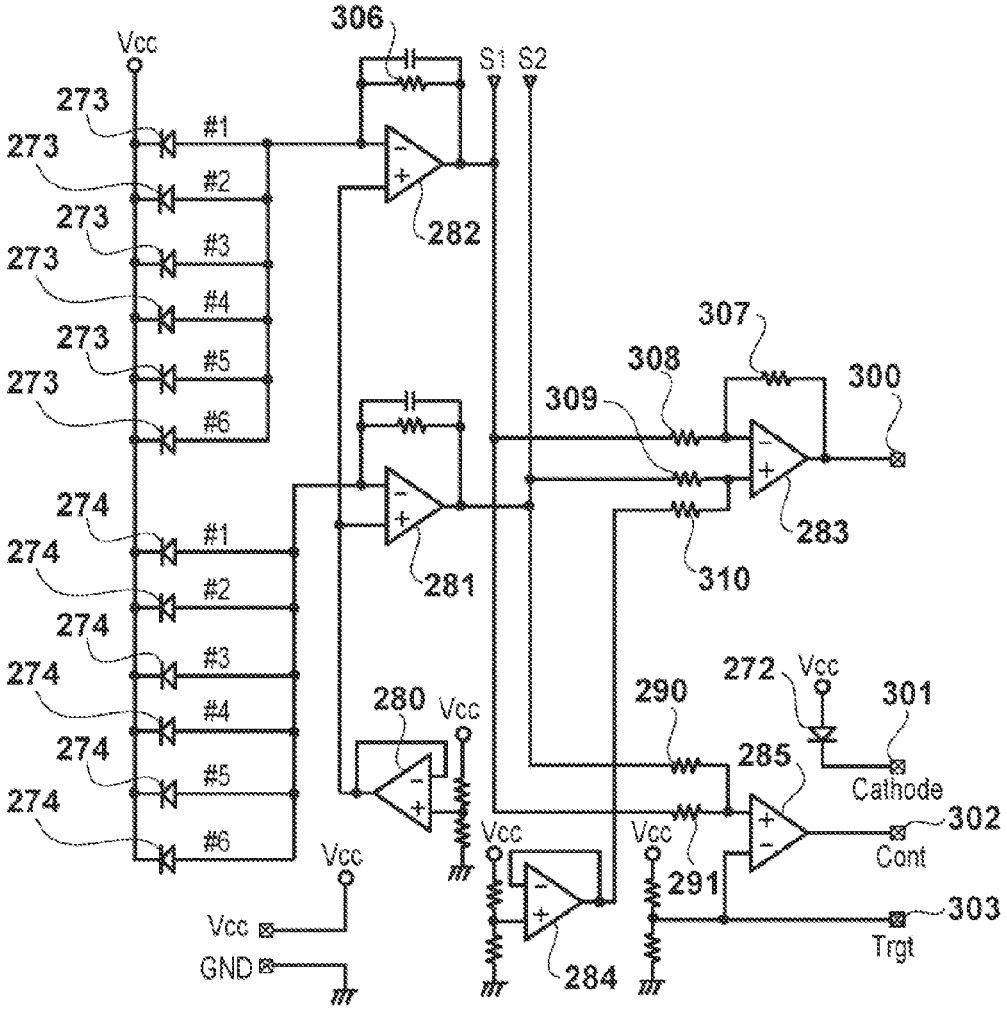
FIG. 13 is a circuit diagram of a sensor according to an embodiment.

Also, although the above description was given in the context of a plurality of light receiving elements 273 and 274 and a plurality of patch images 81 being respectively arrayed at prescribed pitches, the present invention is not limited to this configuration. A light receiving element array may be constituted by a plurality of light receiving elements to realize favorable light receiving characteristics (S/N ratio), and the circuitry of the sensor 27 may be configured as shown in FIG. 13, for example, in terms of canceling the influence of diffuse reflected light. Also, the patch image may be formed and detected as shown in FIG. 14 in response to this.

Figure 14:
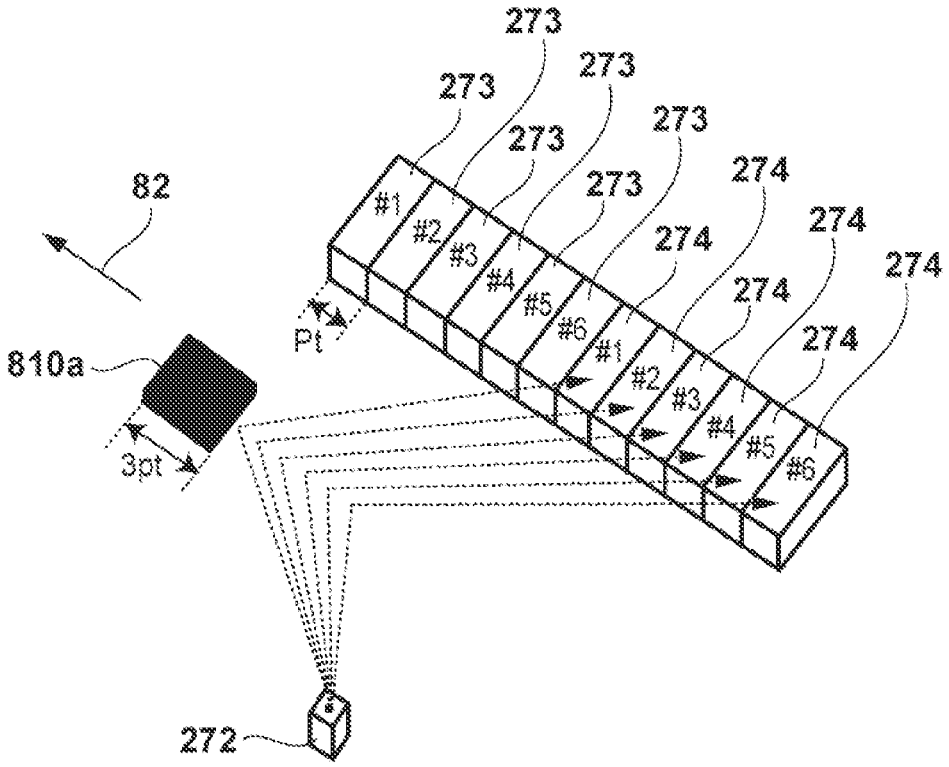
FIG. 14 is a diagram illustrating reception of specular reflected light from a patch image according to an embodiment.

In the case of FIG. 14, a patch image 810*a* (3Pt width in the movement direction of the patch image) reduces or blocks specular reflected light from being incident on the plurality of adjacent light receiving elements 273 numbered #1 to #6. Note that disposing light receiving elements or light receiving units adjacent to each other is to enable the light receiving elements or the light receiving units to receive similar diffuse reflected light. Accordingly, if within the range thereof, a slight gap of less than the width (Pt) of one light receiving pixel, for example, may be provided between the light receiving elements or between the light receiving units. Based on FIG. 13, in the case of wanting to maximize sensor output, specular reflected light from the patch image 810*a* need only be incident on the six light receiving elements 273 (light receiving unit), and specular reflected light from the intermediate transfer belt 8 need only be incident on the light receiving elements 274 (light receiving unit), for example. In this case, if the width of the light receiving units in the movement direction of the patch image 810*a* is then set such that the width in the movement direction of the patch image is the same as the light receiving width (width in the movement direction), on the light receiving units, of specular reflected light from an entirety of one patch image, the amount of toner consumption can be cut. The effect of saving toner in the case of maximizing sensor output is also obtained with the patch image illustrated in FIG. 6.

Also, although not illustrated in FIG. 14, diffuse reflected light reflected from the patch image 810*a* at this time is uniformly incident on the light receiving elements 273 and 274 numbered #1 to #6. That is, the influence of diffuse reflected light is, as described above, also canceled in the output of the differential amplifier 283 with the sensor 27 illustrated in FIGS. 13 and 14. Note that in the case where the pitch of the patch image is zero, as with the patch image 810*a* in FIG. 14, the rectifying circuit 251 and the low pass filter 252 are no longer required, and the sensor output can be input directly to a comparator.

Also, the patch image 810*a* in FIG. 14 corresponds to the 100% density patch image 81*a* in FIG. 10. The condition of light receiving positions, on the light receiving surface of the light receiving elements 273, of light specular reflected at each of two points on the intermediate transfer belt 8 separated by a given distance in a movement direction thereof is assumed to be the same as FIG. 5. In this case, the width of the patch image 810*a* in the movement direction is 18 dots (equivalent to 3Pt), which is 6 times the width in FIG. 10. It is also possible to form and detect halftone patch images corresponding to the patch images 81*b* and 81*c* in FIG. 10, instead of the patch image 810*a*. In this case, the width of the toner-less portions of the respective patch images 81*b* and 81*c* in FIG. 10 need only be set 0 dots. The types of halftone image are, of course, not limited to those illustrated in FIG. 10.

In this way, the present embodiment is not limited to the case where the terminal of the differential amplifier serving as an input point for signals changes every one light receiving element, in relation to light receiving elements adjacently arranged in an array. The patch image and the sensor 27 may be configured such that the terminal of the differential amplifier 283 serving as an input point for signals changes every one or more light receiving elements. In the example of FIGS. 13 and 14, the terminal of the differential amplifier serving as an input point for signals changes every six adjacently arranged light receiving elements. Also, with regard to the question of how many light receiving elements are required before changing the terminal of the differential amplifier serving as an input point for signals, the number of light receiving units can, in the case where one or more light receiving elements are referred to as a light receiving unit, be an arbitrary number of two or more. That is, although the case of two light receiving units is shown in FIGS. 13 and 14, an arbitrary number of two or more light receiving units may be provided.

Furthermore, the pitch of the toner portions and the pitch of the light receiving elements shown in FIG. 5 are the pitches when the light emitting element 272 and the light receiving elements 273 and 274 are in the same plane parallel to the intermediate transfer belt 8, and the present embodiment is not limited to the pitches shown in FIG. 5. In other words, in a case such as where the substrate 271 has a difference in levels, for example, the pitch of the toner portions or the pitch of the light receiving elements can be changed, according to the difference in installation surface of the light emitting element 272 and the light receiving elements 273 and 274. Furthermore, the width of the toner portions and the width of the light receiving elements 273 and 274 are not limited to the widths shown in FIG. 5. For example, in FIG. 5, it is clear that output such as shown in FIG. 9 can also be obtained if the width of the toner portions is increased beyond Pt/2, to 3Pt/4, for example, while keeping the pitch of the toner portions at Pt.

For example, if the pitch of the toner portions is D (first pitch/first distance), light specular reflected at respective positions separated by D in the movement direction of the intermediate transfer belt 8 will be at a distance of L when received by the light receiving elements 273 and 274. In this case, the pitch of the light receiving elements 273 and 274 (second pitch/second distance) need only be respectively set to L. In other words, the distance L can be increased an arbitrary n times the distance D (where n is a positive number greater than 1).

Second Embodiment

Figure 15:
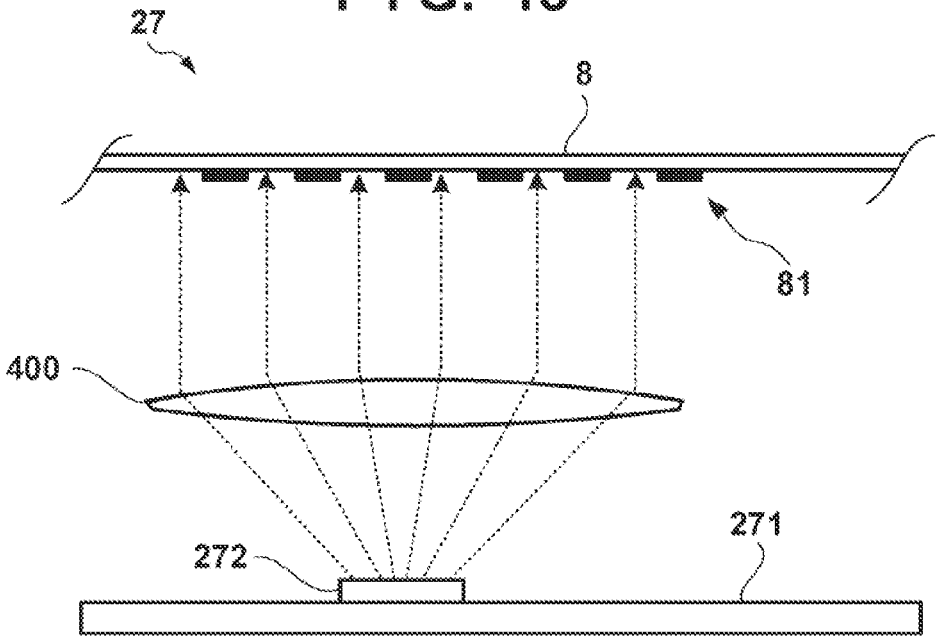
FIG. 15 is a diagram illustrating reception of specular reflected light from a patch image according to an embodiment.

Next, a second embodiment will be described focusing on differences with the first embodiment. Note that the same reference numerals are used for similar constituent elements to the first embodiment, and description thereof is omitted. In the present embodiment, as shown in FIG. 15, a lens 400 is provided in the sensor 27, and light from the light emitting element 272 is irradiated onto the intermediate transfer belt 8 after being converted into parallel light.

Figure 16:
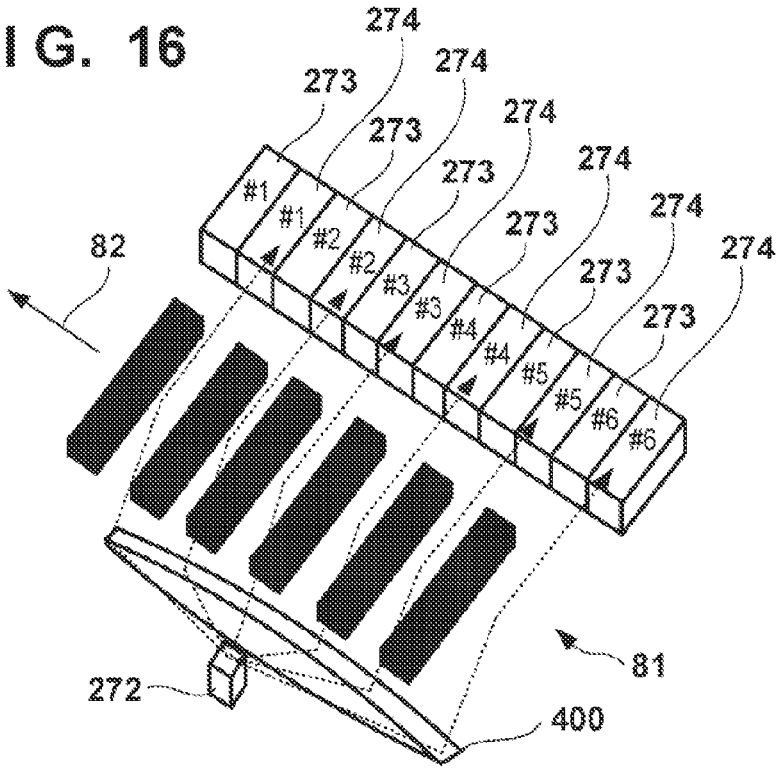
FIG. 16 is a perspective view illustrating reception of specular reflected light from a patch image according to an embodiment.
Figure 17:
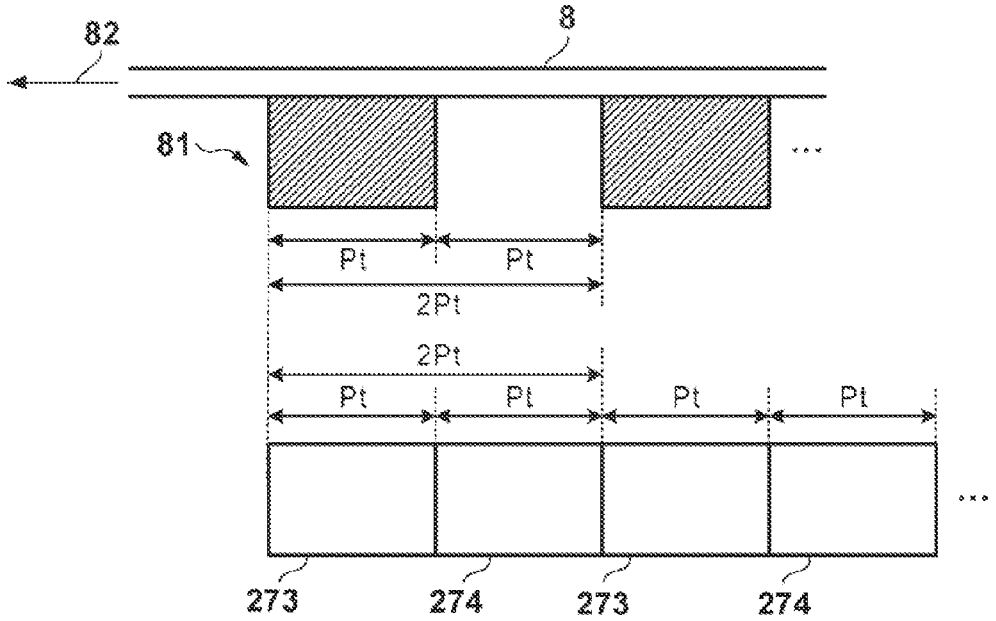
FIG. 17 is a diagram showing the relationship between the pitch of light receiving elements of a sensor and the pitch of lines of a patch image according to an embodiment.

In the present embodiment, the pitch of the toner portions of the patch image 81 is 2Pt, as shown in FIG. 17. In other words, the pitch of adjacent light receiving elements 273 and 274 is equal to the pitch of the toner portions. As shown in FIG. 16, light from the light emitting element 272 is corrected and converted into parallel light by the lens 400. Parallel light that is incident on the toner-less portions of the patch image 81 is specular reflected, and, as shown in FIG. 16, is incident on only the light receiving elements 273 or 274 according to the position of the patch image 81. In contrast, light that is incident on the toner portions of the patch image 81 is diffuse reflected, and is incident on the light receiving elements 273 and 274, similarly to the first embodiment. The dotted-line arrows in FIG. 16 show light that is incident on the light receiving elements 273 after having been specular reflected by the toner-less portions of the patch image 81.

In the present embodiment, the output of the sensor 27 when the patch image 81 moves together with the intermediate transfer belt 8 is similar to the first embodiment. In the present embodiment, irradiated light is converted to parallel light by the lens 400. Thus, even in the case where the sensor 27 and the intermediate transfer belt 8 are separated at a distance, there is an advantage in that there is no accompanying drop in light quantity due to diffusion of light. Therefore, restrictions on the disposition position of the sensor 27 are reduced, and flexibility in device design increases. Also, similar advantages are obtained when the circuitry and the patch image described in FIGS. 13 and 14 are applied to the second embodiment.

Third Embodiment

Next, a third embodiment will be described focusing on differences with the first embodiment. Note that the same reference numerals are used for similar constituent elements to the first embodiment, and description thereof is omitted. In the present embodiment, the light receiving elements 273 and 274 of the sensor 27 are made smaller (narrower), enhancing the cost advantage.

Figure 18:
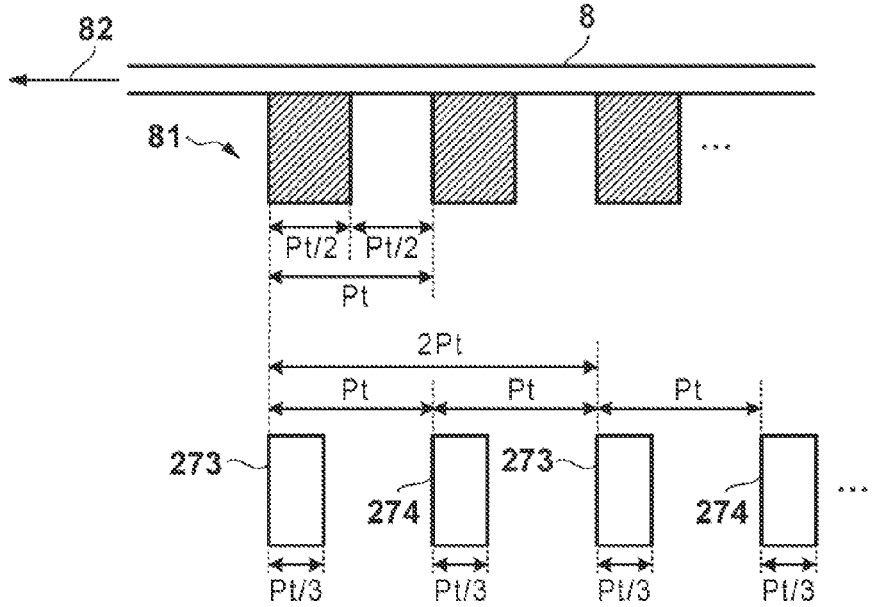
FIG. 18 is a diagram showing the relationship between the pitch of light receiving elements of a sensor and the pitch of lines of a patch image according to an embodiment.

FIG. 18 shows the relationship between the light receiving elements 273 and 274 and the toner portions and toner-less portions of the patch image 81 in the present embodiment. A difference with the first embodiment is that the width of the light receiving elements 273 and 274 is set to ⅓ of Pt while keeping the pitch of the light receiving elements at 2Pt. Note that ⅓ is merely an example, and other sizes can also be used.

Figure 19:
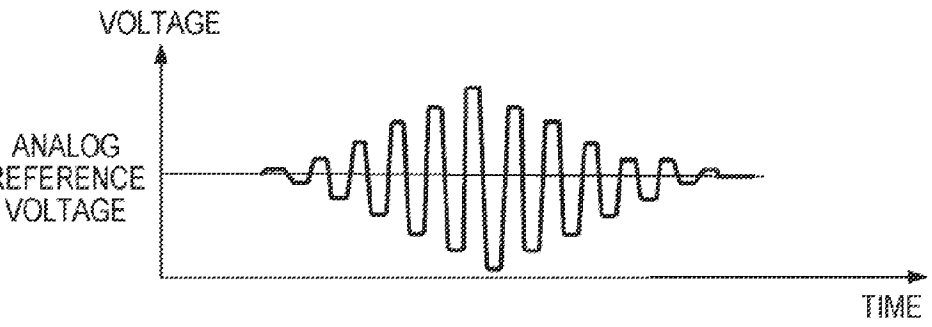
FIG. 19 is a diagram showing an output waveform of a sensor according to an embodiment.

Also in the present embodiment, the output waveform of the sensor 27 will, as shown in FIG. 19, have a shape that oscillates around the analog reference voltage Vref, similarly to the first embodiment. However, in the present embodiment, the width, at the position of the light receiving elements, of light reflected at positions separated by the width of the toner portions is three times the width of the light receiving elements 273 and 274. Since the light receiving portions of the light receiving elements 273 and 274 have the same width as the light receiving elements 273 and 274, in the present embodiment the, peak value will continue for longer than the first embodiment. Therefore, the waveform will be trapezoidal in shape, as shown in FIG. 19.

Figure 20:
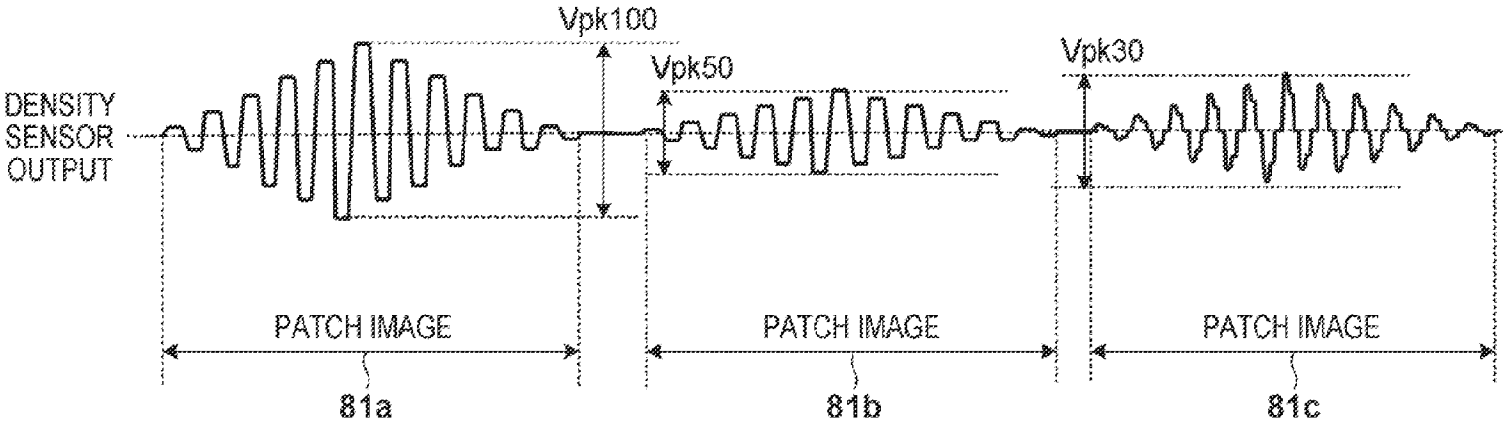
FIG. 20 is a diagram showing output waveforms of a sensor relative to patch images according to an embodiment.

Vpk100, Vpk50 and Vpk30 in FIG. 20 are respectively the maximum outputs of the sensor 27 in the case where the patch images 81*a*, 81*b* and 81*c* in FIG. 10 are used. Note that the configuration of the sensor 27 is similar to that of the first embodiment, and description thereof is omitted here. The patterns shown in FIG. 10 each consists of stripes every 3 dots. On the other hand, the light receiving elements 273 and 274 of the present embodiment will sequentially receive reflected light corresponding to a line width of 1 dot, irrespective of whether the reflected light is from the patch image or from intermediate transfer belt.

In the case of the patch image 81*a*, the amplitude shown by Vpk100 will have a waveform that continues for a period of time equivalent to a 3-dot line, as shown in FIG. 20. In the case of the patch image 81*b*, Vpk50, whose voltage is 50% of Vpk100, will have a waveform that continues for a period of time equivalent to a 3-dot line, since the toner ratio for 1 dot is also 50% of the patch image 81*a*. The toner ratios of the first to third dot lines of the patch image 81*c* are 66%, 33% and 0%, respectively. Accordingly, as shown in FIG. 20, respective voltages of 66%, 33% and 0% relative to Vpk100 will have waveforms that each continues for a period of time equivalent to 1-dot line.

Figure 21A:
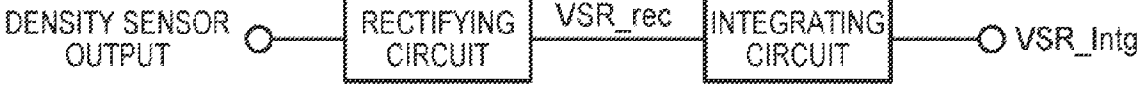
FIG. 21A is a block diagram of a control unit according to an embodiment.

In the case of the present embodiment, as shown in FIG. 20, the peak values of the sensor 27 do not coincide with the densities of the patch images 81. However, values obtained by integrating the output of the sensor 27 on the time axis do coincide with the densities of the patch images 81. Accordingly, as shown in FIG. 21A, in the present embodiment, the control unit 25 is provided with a rectifying circuit 253 and an integrating circuit 254, and integrates the output of the sensor 27 after halfwave rectification.

Figure 21B:
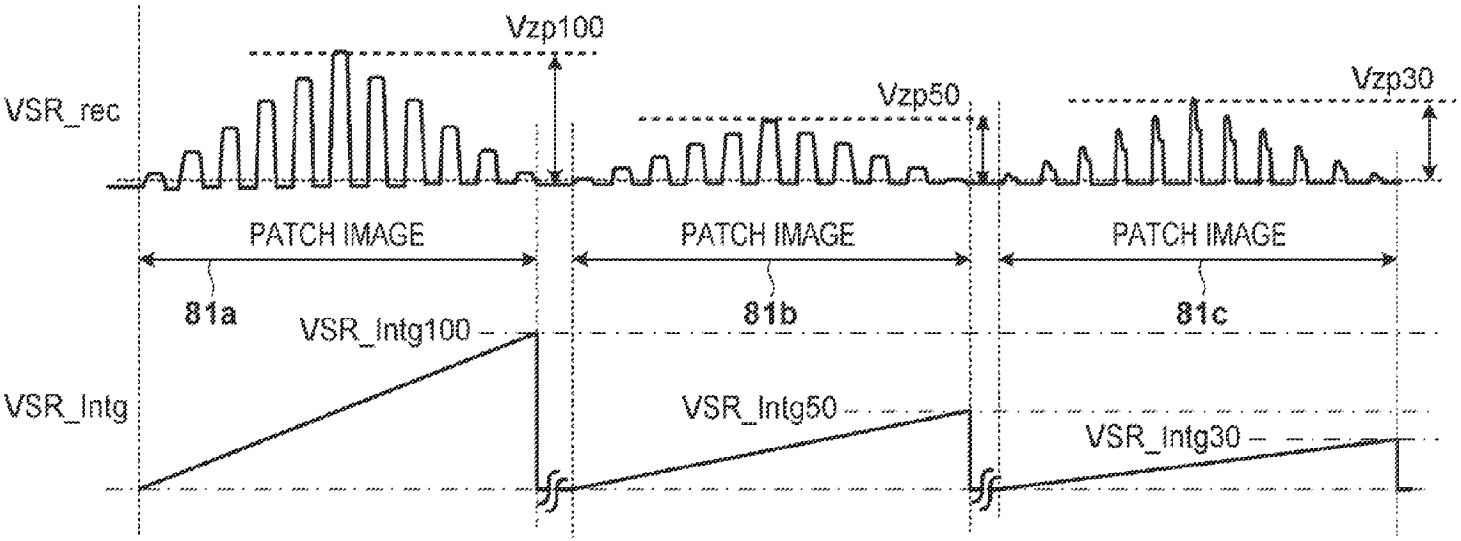
FIG. 21B is a diagram showing waveforms of the components in FIG. 21A.

FIG. 21B shows an output VSR_rec of the halfwave rectifying circuit 253 and an output VSR_Intg of the integrating circuit 254 for each patch image. The output VSR_Intg will be a density value substantively indicating the density of the patch image. The control unit 25 controls the image forming conditions described in the first embodiment based on this output VSR_Intg. Vzp100 is a peak value of the output signal of the rectifying circuit 253 when the sensor 27 has measured the patch image 81*a*. Also, VSR_Intg100 is an integral value of the integrating circuit 254 when the patch image 81*a* is measured. Note that Vzp50 and VSR_Intg50 are the respective values when the patch image 82*a* is measured, and Vzp30 and VSR_Intg30 are the respective values when the patch image 82*c* is measured. As shown in FIG. 21B, the integral values are proportional to the densities of the patch images.

Hereinabove, in the present embodiment, in addition to the effects described in the abovementioned embodiments, the width of the light receiving elements 273 and 274 is made narrower than the width of the lines of the patch image formed by toner. Low-cost light receiving elements can thereby be used. Note that the circuits shown in FIG. 21A, or in other words, integration, can be used in place of the peak value detection of the first embodiment and the second embodiment. In this case, the sensor output from the terminal 300 in the first embodiment and the second embodiment is input to the rectifying circuit 253. The control unit 250 then need only derive the integral value VSR_Intg output from the integrating circuit 254.

OTHER EMBODIMENTS

Aspects of the present invention can also be realized by a computer of a system or apparatus or devices such as a CPU or MPU that reads out and executes a program recorded on a memory apparatus to perform the functions of the above to described embodiments, and by a method, the steps of that are performed by a computer of a system or apparatus by, for example, reading out and executing a program recorded on a memory apparatus to perform the functions of the above to described embodiments. For this purpose, the program is provided to the computer for example via a network or from a recording medium of various types serving as the memory apparatus (e.g., computer to readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-146334 filed on Jun. 30, 2011 and Japanese Patent Application No. 2011-185258 filed on Aug. 26, 2011, which are hereby incorporated by reference herein in their entirety.

The invention claimed is:

1. An image forming apparatus comprising:

an image carrier;

an image forming unit configured to form a patch image including a plurality of patterns on the image carrier;

a light emitting unit;

a plurality of light receiving units adjacently arranged so as to receive light reflected from the patch image when light is irradiated by the light emitting unit onto the patch image which moves with movement of the image carrier, and each including one or more light receiving elements; and an output unit configured to output an output signal that depends on a difference between a received light quantity of a first light receiving unit and a received light quantity of a second light receiving unit that are respectively odd-numbered and even-numbered in an arrangement order of the light receiving units, wherein the plurality of light receiving units is configured to receive light reflected from the plurality of patterns, the output unit is further configured to output the output signal indicating a first value when the plurality of light receiving units receives light from a first number of patterns among the plurality of patterns, and to output the output signal indicating a second value greater than the first value when the plurality of light receiving units receives light from a second number of patterns, which is greater than the first number of patterns, among the plurality of patterns, the patch image includes one or more lines, the light emitting unit and the plurality of light receiving units are arranged such that the received light quantity of the first light receiving unit and the received light quantity of the second light receiving unit, of light irradiated by the light emitting unit and reflected by the patch image, vary with movement of the image carrier, and respectively differ, and wherein the plurality of light receiving units is arranged at different positions in a movement direction of the image carrier.

2. The image forming apparatus according to claim 1, wherein the light reflected from the patch image includes diffuse reflected light and specular reflected light, and variation in diffuse reflected light is common to the first light receiving unit and the second light receiving unit.

3. The image forming apparatus according to claim 1, wherein diffuse reflected light from the patch image is received by both the first light receiving unit and the second light receiving unit, and specular reflected light from the patch image is received by one of the first light receiving unit and the second light receiving unit.

4. The image forming apparatus according to claim 1, wherein the patch image includes a plurality of lines arranged at a first pitch in a movement direction of the patch image, the first light receiving unit and the second light receiving unit are respectively arranged at a second pitch, and light beams irradiated by the light emitting unit and specular reflected at positions on the image carrier that are separated by the first pitch in the movement direction become the second pitch at a surface on which the light receiving units are arranged.

5. The image forming apparatus according to claim 4, further comprising a converting unit configured to convert light irradiated by the light emitting unit into parallel light, wherein the second pitch is equal to the first pitch.

6. The image forming apparatus according to claim 1, wherein a width of light in a movement direction of the image carrier when specular reflected light is received by the light receiving units from an entirety of the patch image is the same as a width of the light receiving units in the movement direction.

7. The image forming apparatus according to claim 1, further comprising a control unit configured to control an image forming condition of the image forming unit based on the output signal of the output unit.

8. The image forming apparatus according to claim 7, wherein the control unit is further configured to control the image forming condition based on a peak value of the output signal from the output unit.

9. The image forming apparatus according to claim 7, further comprising:

a rectifying unit configured to rectify the output signal from the output unit; and an integrating unit configured to integrate an output of the rectifying unit, wherein the control unit is further configured to control the image forming condition based on an integral value output by the integrating unit.

10. The image forming apparatus according to claim 7, wherein a width of each of the first light receiving unit and the second light receiving unit in the movement direction of the patch image is narrower than a width of the lines of the patch image, the control unit further includes a rectifying unit configured to rectify the output signal from the output unit, and an integrating unit configured to integrate an output of the rectifying unit, and the control unit is further configured to control the image forming condition based on an integral value output by the integrating unit.

11. The image forming apparatus according to claim 1, further comprising a light quantity control unit configured to control a light emission intensity of the light emitting unit, based on the difference in received light quantity between the first and second light receiving units.

12. The image forming apparatus according to claim 1, wherein each of the plurality of light receiving units is configured to receive specular reflection light from the image carrier and diffuse reflection light from the patch image depending on a movement of the patch image.

* * * * *